US011460199B2

(12) United States Patent
Peutl et al.

(10) Patent No.: US 11,460,199 B2
(45) Date of Patent: Oct. 4, 2022

(54) CLIMATE CONTROL OF DIRECT PRINTING MACHINES

(71) Applicant: Krones AG, Neutraubling (DE)

(72) Inventors: August Peutl, Woerth/Donau (DE); Franz Weigl, Pfakofen (DE); Valentin Becher, Donaustauf (DE)

(73) Assignee: Krones AG, Neutraubling (DE)

( * ) Notice: Subject to any disclaimer, the term of this patent is extended or adjusted under 35 U.S.C. 154(b) by 1050 days.

(21) Appl. No.: 16/052,428

(22) Filed: Aug. 1, 2018

(65) Prior Publication Data

US 2019/0070875 A1 Mar. 7, 2019

(30) Foreign Application Priority Data

Sep. 4, 2017 (DE) ..... 10 2017 215 434.9

(51) Int. Cl.

| | |
|---|---|
| ***B41J 2/17*** | (2006.01) |
| ***F24F 7/007*** | (2006.01) |
| ***B41J 3/407*** | (2006.01) |
| ***F24F 5/00*** | (2006.01) |
| ***F24F 7/08*** | (2006.01) |

(Continued)

(52) U.S. Cl.

CPC ..... *F24F 7/007* (2013.01); *B41J 2/1714* (2013.01); *B41J 3/4073* (2013.01); *B41J 3/40733* (2020.08); *B41J 29/12* (2013.01); *B41J 29/17* (2013.01); *B41J 29/377* (2013.01);

(Continued)

(58) Field of Classification Search

CPC ..... B41J 29/377

See application file for complete search history.

(56) References Cited

U.S. PATENT DOCUMENTS

| | | | |
|---|---|---|---|
| 4,008,401 A | 2/1977 | Holoubek et al. | |
| 5,424,806 A | 6/1995 | Siegel | |

(Continued)

FOREIGN PATENT DOCUMENTS

| | | | |
|---|---|---|---|
| CA | 2285885 A1 * | 4/2001 | ..... B41J 29/17 |
| CN | 101668649 A | 3/2010 | |

(Continued)

OTHER PUBLICATIONS

German Search Report for DE 10 2017 215 434.9 dated Dec. 12, 2017, 7 pages, German only.

(Continued)

*Primary Examiner* — Julian D Huffman

(74) *Attorney, Agent, or Firm* — Lowenstein Sandler LLP

(57) ABSTRACT

The present disclosure relates to a device for climate control of an interior of a machine in a food and beverage industry. The device includes an air discharge system for discharging air from the interior of the machine. The air discharge system includes a first air extraction duct configured for first selective extraction of contaminated air or second selective extraction of high-temperature air or at least two separate air extraction ducts including a first air extraction duct configured for the first selective extraction of the contaminated air and a second air extraction duct configured for the second selective extraction of the high-temperature air. The device further includes an air supply system for supplying air to the interior of the machine. The supplied air includes at least one of fresh air or purified extracted air.

18 Claims, 1 Drawing Sheet

(51) Int. Cl.

| | |
|---|---|
| ***F24F 7/04*** | (2006.01) |
| ***B41J 29/377*** | (2006.01) |
| ***B41J 29/12*** | (2006.01) |
| ***B41J 29/17*** | (2006.01) |

(52) U.S. Cl.
CPC ..... *F24F 5/00* (2013.01); *F24F 7/04* (2013.01); *F24F 7/08* (2013.01)

(56) References Cited

U.S. PATENT DOCUMENTS

| | | | |
|---|---|---|---|
| 5,634,176 | A | 5/1997 | Ayash et al. |
| 9,090,090 | B2 | 7/2015 | Putzer et al. |
| 2007/0009283 | A1 | 1/2007 | Shirakata et al. |
| 2011/0109689 | A1 | 5/2011 | Sugimoto et al. |
| 2012/0001991 | A1 | 1/2012 | Onozawa et al. |
| 2014/0290515 | A1 | 10/2014 | Schach |

FOREIGN PATENT DOCUMENTS

| | | | |
|---|---|---|---|
| CN | 103380004 | A | 10/2013 |
| CN | 204955722 | U | 1/2016 |
| CN | 106489212 | A | 3/2017 |
| CN | 204774132 | | 3/2017 |
| DE | 695 16 920 | T2 | 10/2000 |
| DE | 10 2009 013 477 | A1 | 9/2010 |
| DE | 102009013477 | A1 | 9/2010 |
| DE | 102011119171 | B3 | 2/2013 |
| DE | 10 2013 217 663 | A1 | 3/2015 |
| EP | 2743087 | A1 | 6/2014 |
| JP | 2004-058445 | A | 2/2004 |
| JP | 2005271314 | A | 10/2005 |
| JP | 2014133398 | A | 7/2014 |
| WO | 2010105726 | A1 | 9/2010 |

OTHER PUBLICATIONS

European Serch Report for EP 18170525.2 dated Dec. 13, 2018, 14 pages, German only.

Chinese Office Action dated Mar. 4, 2020, on application No. 201810961443.5.

* cited by examiner

CLIMATE CONTROL OF DIRECT PRINTING MACHINES

RELATED APPLICATIONS

This Application claims the benefit under 35 U.S.C. § 119(a) of German Patent Application No. 10 2017 215 434.9, filed Sep. 4, 2017, which is incorporated by reference herein.

TECHNICAL FIELD

The present disclosure relates to a device, a method, and a direct printing machine.

BACKGROUND

It is known for machines in the food and beverage industry, for example, for equipping devices such as direct printing machines for printing onto containers, to use ventilation systems for regulating the work environment conditions of the machines.

A drawback of known ventilation systems or climate control systems in the food and beverage industry is the high consumption of fresh air. Another drawback is too high a degree of contamination of the air in the interior of the machine to be ventilated. Another drawback is a degree of air purity which insufficiently satisfies the special requirements of the food and beverage industry. Another drawback is inefficient and inaccurate temperature control of the machine to be ventilated.

BRIEF DESCRIPTION OF THE DRAWINGS

Embodiments of the present disclosure are illustrated by way of example, and not by way of limitation, in the figures of the accompanying drawings.

DETAILED DESCRIPTION

Figure 1:
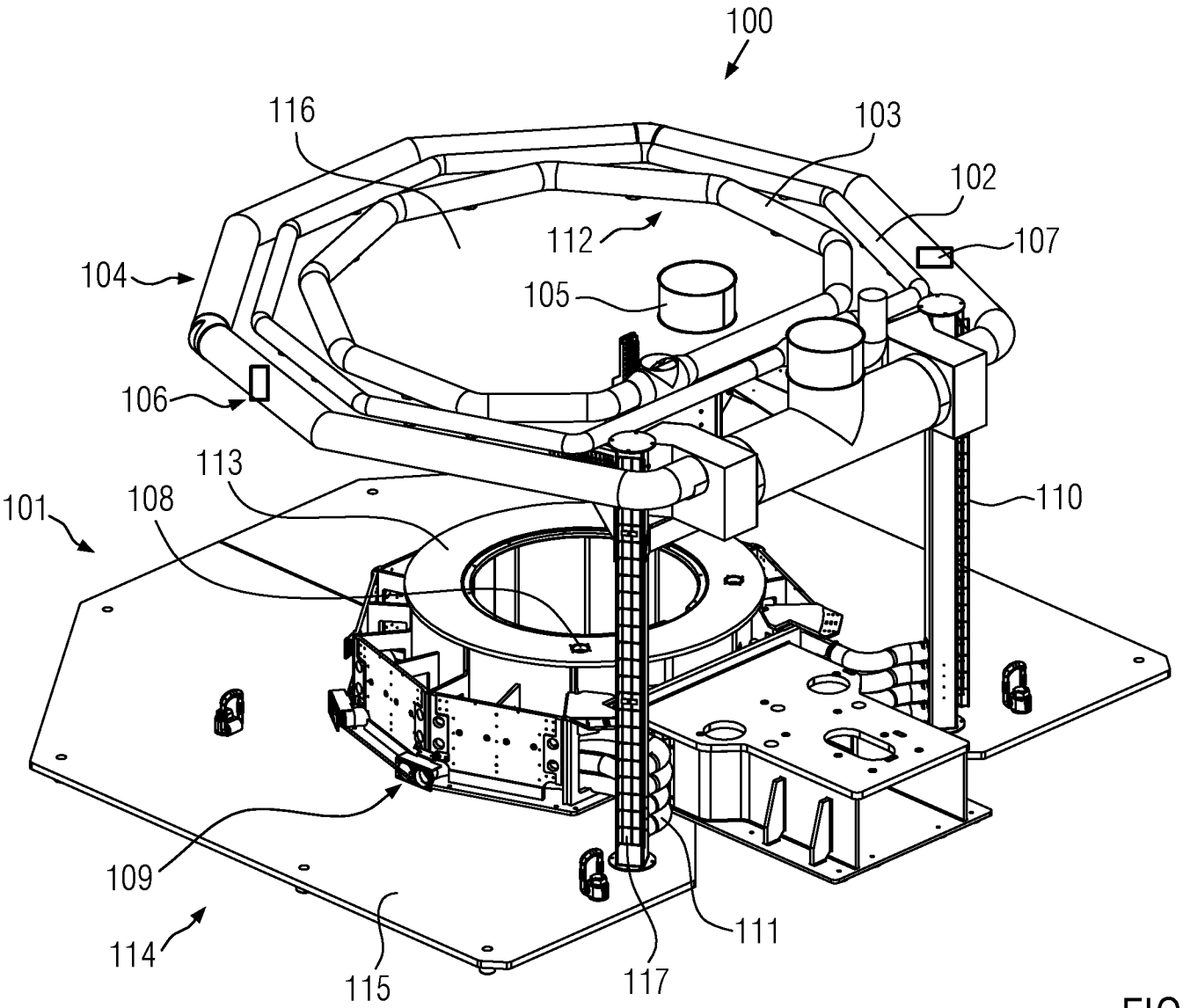
FIG. 1 illustrates a device for climate control of an interior of a machine in the food and beverage industry, according to certain embodiments.

The present disclosure may provide a device and a method for climate control of a machine in the food and beverage industry, e.g. a direct printing machine. The present disclosure may provide a device and a method for climate control of a machine in terms of the quality and stability of climatic conditions within the machine interior.

A device according to the present disclosure for climate control of an interior of a machine in the food and beverage industry (e.g., for climate control of an interior of a direct printing machine) can include, inter alia, at least one air discharge system for discharging air from the interior of the machine. In some embodiments, the at least one air discharge system includes at least one air extraction duct. In some embodiments, the at least one discharge system includes at least two separate air extraction ducts.

In some embodiments, the at least one air extraction duct is configured for the selective extraction of contaminated air, e.g. print mist. In some embodiments, the at least one air extraction duct is configured for the selective extraction of high-temperature air, e.g. of air heated by light sources for hardening and/or curing inks.

In some embodiments, the air discharge system includes at least two separate air extraction ducts, where at least one air extraction duct is configured for the selective extraction of contaminated air, e.g. print mist, and e.g. at least one other air extraction duct is configured for the selective extraction of high-temperature air, e.g. of air heated by light sources for hardening and/or curing inks. The air extraction ducts can then be independent of each other.

In addition, the device according to the present disclosure for climate control of an interior of a machine can include at least one air supply system for supplying air to the interior of the machine, where the air supplied can include fresh air and/or purified extracted air.

The air supply system can include a plurality of air supply ducts which can be separate and independent of each other. For example, the air supply system can include air supply ducts for the separate supply of fresh air and purified recycled air and for a mixture of fresh air and purified recycled air.

In some embodiments, the device for climate control of an interior of a machine can circulate the air in the interior, i.e. constantly remove air from the interior of the machine and re-supply it. The air previously removed can optionally be purified or filtered and at least in part be delivered back to the interior of the machine.

The device can therefore be configured to form an air recycling circuit for the air in the interior of the machine, e.g. in the interior of a direct printing machine. This can improve energy efficiency of the device, reduce the consumption of fresh air, as well as avoid or reduce unwanted leakage of contaminated air.

The selective and/or separate discharge or extraction of contaminated air also makes it possible that not the entire air throughput of the device must be purified or filtered, but, for example, only the portion that has been extracted via the at least one air extraction duct for the selective extraction of contaminated air.

Selective extraction or discharge of air can be understood to mean that air is selectively extracted at individual components or component assemblies of the machine.

For example, the selective extraction of contaminated air can be understood to mean that air is extracted directly at or near those components or component assemblies of the machine at or near which the air is contaminated, e.g. at or near the printheads of printing assemblies of a direct printing machine where print mist can develop.

The selective extraction of contaminated air directly at or near components or component assemblies of the machine can optionally be effected, for example, by way of hoses which can be connected e.g. to the at least one air discharge system or to an air extraction duct of the air discharge system, respectively.

Selective extraction of high-temperature air can likewise be understood to mean that air is extracted directly at or near those components or component assemblies of the machine, at or near which the air is heated as compared to other components or as compared to the ambient temperature, e.g. at or near light sources, e.g. ultraviolet (UV) light sources in pinning lamps, for hardening and/or curing inks.

The selective extraction of high-temperature air, e.g. air at temperatures of about 60° C. or more, directly at or near components or component assemblies of the machine can there inter alia likewise be optionally effected, for example, by way of hoses which can be connected e.g. to the at least one air discharge system or to an air extraction duct of the air discharge system, respectively.

Alternatively or additionally, air can also be selectively extracted at components which are e.g. to be actively cooled. For example, separate ventilation of the component, e.g. by way of a fan, can then be dispensed with.

In addition to improved energy efficiency, the device presently described enables, inter alia, that mixing of contaminated air and clean air can be prevented and that the contamination of components in the interior and of the ventilation equipment of the machine and/or the contamination of products can prevented or reduced.

The stress on components of the machine due to hot exit air from other components can likewise be prevented, so that, inter alia, unnecessary thermal expansion of components, which can adversely affect the operation of the machine, possibly leading, inter alia, to a loss of accuracy of a printing process, can be prevented or reduced.

The device for climate control of an interior of a machine can also be configured to generate an overpressure (e.g., positive pressure) in the interior of the machine. Said overpressure in the interior of the machine can be understood to mean a pressure which is above the pressure that prevails in the exterior of the machine, or in the adjacent environment of the machine, respectively.

This can enable, inter alia, that air can constantly or continuously flow out or escape from the interior of the machine to the exterior, e.g. into the environment. For example, it can be prevented that contaminants such as e.g. dust or foreign air, enter through openings or leaks of the machine to the interior of the machine. In other words, for example, uncontrolled entry of undefined air to the interior of the machine can thus be prevented.

This overpressure can be effected, for example, by the at least one air supply system for supplying air to the interior of the machine or by supplying it into the air circuit, e.g. in that air is supplied just upstream of a possible air filter.

The overpressure within the machine that can be generated by the device can be, for example, 5 to 15 Pa or up to 25 Pa.

The device can include e.g. a plurality of air outlet openings, via which air can escape from the interior of the machine to the exterior or into a space surrounding the machine.

In addition, the device can additionally include at least one air purification unit, e.g. an activated carbon filter, for purifying and/or drying air that is extracted through the at least one air discharge system.

The device can alternatively or additionally include at least one air temperature control unit for controlling the temperature of air to be supplied to the machine interior, e.g. an air cooling unit for cooling air to be supplied to the machine interior.

The device can be configured, for example, such that temperature control, e.g. the cooling of air to be supplied, is performed by an air purification unit only after the air to be supplied has previously been purified or filtered, for example when the air to be supplied is recycled air (e.g., which has previously been extracted from the interior of the machine).

In some embodiments, the device includes at least one humidification unit. The at least one humidification unit may be adapted to humidify at least a portion of the air to be supplied, e.g. create and ensure a desired predetermined humidity in the interior of the machine.

The device presently described can enable precise climate control (e.g., of the temperature and the humidity in the interior of the machine) and thereby ensure a stable optimum climate desired in the machine interior.

With the device presently described by way of example, at least some of the structural machine components of the machine to be climate controlled can serve as an air supply system and/or air discharge system.

Some structural machine components or parts of structural machine components can be at least partially designed as air ducts for the supply and/or discharge of air.

A structural machine component can be understood to be, inter alia, machine components which are used for the static stability of the machine, or components that are necessary and/or not dispensable for the stability of the machine.

This can make it possible, inter alia, to dispense with additional machine components when realizing climate control of the machine interior. Room and installation space can be saved in this manner and the device for climate control of the interior of the machine can be designed to be more compact.

The at least one air supply system of a device for climate control of an interior of a machine may include e.g. at least one ring manifold or at least one ring line for supplying air to the interior of the machine (e.g., in the ceiling region of the interior of the machine).

This can facilitate, inter alia, uniform ventilation of the interior of the machine.

The use of ring lines can have an advantage of saving installation space (e.g., since not every termination point needs to be provided with a tube).

For example, when closing an opening or a control valve, the volumetric flow can distribute more uniformly to the remaining openings than if the line were not closed or not ring-shaped.

For example, the most homogeneous possible air distribution can be obtained due to a uniform distribution of openings of the same size, respectively adapted to the application.

The at least two separate air extraction ducts of the at least one air discharge system can at least in part be configured as separate ring lines or individual lines in the ceiling region of the interior or on the ceiling outside the machine.

In addition to the separate air extraction ducts of the at least one air discharge system, the device can alternatively or additionally also include a central discharge in the ceiling region of the interior of the machine for extracting air from the interior of the machine, which, among other things, can increase the extraction capacity of the air discharge system.

The device may include at least one air supply system that includes a plurality of air supply openings for supplying air to the interior of the machine (e.g., for the selective supply of air to the interior of the machine).

In some embodiments, selective supply of air to the interior of the machine includes individual components or component assemblies of the machine are selectively or directly ventilated with supplied air. Inter alia, hoses can be used which can be connected (e.g., to the air supply system) and which can be directed toward individual components or component assemblies of the machine. In some embodiments, the selective supply of air to the interior of the machine can be effected directly via the air supply openings.

In some embodiments, a majority of the plurality of air supply openings for supplying air to the interior of the machine can be arranged in the bottom region of the interior of the machine so that components or component assemblies of the machine can be ventilated at or in the vicinity of the floor region of the machine In some embodiments, the air supplied or supply air, respectively, can be supplied e.g. to a turntable of the machine, e.g. a turntable of a direct printing machine, and/or e.g. supply air can be passed between various print assemblies.

As mentioned herein, the supply air can include fresh air and/or purified air previously removed from the machine and/or cooled air or a mixture of fresh air and recycled air. The air supplied can be used for temperature control (e.g., for cooling the interior of the machine or for cooling components or component assemblies of the machine).

This can allow for (e.g., ensure), for example, firstly, a constant temperature of the ventilated components or component assemblies and, secondly, compensation for a possible exit air flow or possible exit air flows, e.g. created by air extraction ducts or air extraction hoses of the possible air discharge system, for example, an exit air flow in the vicinity of pinning units or pinning lamps of a printing assembly.

In some embodiments, air supply openings for supplying air to the interior of the machine can be arranged in the ceiling region of the interior of the machine, so that components or component assemblies of the machine can be selectively ventilated at or in the vicinity of the ceiling region of the machine.

The device presently described, in which the at least one air supply system can include a plurality of air supply openings for supplying air to the interior of the machine, can be further configured such that at least some of the air supply openings can include a controllable control valve or throttle valve for regulating the air supply, or for regulating the supply air in the interior of the machine.

The air supply system can therefore be configured such that different regions of the interior of the machine can be ventilated in a selectively variable manner as needed and/or depending on the ambient temperature and/or depending on the ambient humidity.

The manner in which the interior of the machine is ventilated by the air supply system can then be controlled at air supply openings, for example, by way of the control valves.

For example, the control valves can be adjusted such that a maximum supply air flow to the lower region, i.e. to the bottom region, is supplied and as needed or, for example, at high ambient temperatures, an additional air flow can be supplied from above, in/from the ceiling region of the machine.

A method for climate control of an interior of a machine in the food and beverage industry (e.g., for climate control of an interior of a direct printing machine) can therefore include one, some, or all of the following acts:

discharging air from the interior of the machine by way of at least one air extraction duct, where contaminated air, e.g. print mist, can be selectively extracted at machine components and/or high-temperature air, e.g. air heated by light sources for hardening and/or curing inks, can be selectively extracted at machine components, or discharging air from the interior of the machine by way of at least two separate air extraction ducts, where contaminated air, e.g. print mist, can be selectively extracted at machine components and where high-temperature air, e.g. air heated by light sources for hardening and/or curing inks, can be selectively extracted at machine components, and supplying air to the interior of the machine, where the supplied air can include fresh air and/or purified extracted air.

The discharged air can there be purified and/or temperature-controlled, e.g. be cooled, and/or dried or humidified before at least a portion of the air discharged from the interior of the machine can be returned to the interior of the machine.

Inter alia, by supplying air to the interior of the machine, an overpressure can additionally be created, e.g. of 5 to 25 Pa or more, in the interior of the machine and air from the interior of the machine can be purged out, e.g. through air vents, e.g. can be purged to a room surrounding the machine or to an external space.

A direct printing machine for use in the food and beverage industry (e.g., for printing onto containers) can include a device for climate control which can include some or all of the features of the device for climate control of an interior of a machine described herein.

In some embodiments, a generator for operating the device for climate control of an interior of a machine can be arranged outside the interior of the machine.

FIG. 1 illustrates by way of example a device 100 for climate control of an interior of a machine, where machine 114, e.g. a direct printing machine, is shown only in part, i.e. where only some of the possible components in interior 101 of the machine are shown or indicated.

Possible panels or a possible housing of the machine, which can separate interior 101 from an external space or from a space surrounding the machine, are also not shown.

A possible air discharge system 112 for discharging air from interior 101 of machine 114 is shown by way of example.

Said possible air discharge system 112 for discharging air from interior 101 of machine 114 can include, for example, an air extraction duct, embodied by way of example as a ring line 102, which can be configured for the selective extraction of contaminated air, e.g. print mist of printing assemblies (not shown) of a direct printing machine.

In addition, air discharge system 112 for discharging air from interior 101 of machine 114 can include a further air extraction duct, ring line 103, which can be configured for the selective extraction of high-temperature air, e.g. air heated by light sources, e g pinning lamps for hardening and/or curing inks.

In some embodiments, air discharge system 112 for discharging air from interior 101 of machine 114 also includes a central discharge or a central extraction 105, respectively, e.g. a central extraction tube, for example, mounted in ceiling portion 116 of the interior of the machine.

Device 100 can likewise include an air supply system 104 for supplying air to interior 101 of the machine, through which e.g. fresh air and/or purified extracted air and/or cooled fresh or cooled purified air and/or a mixture of said airs can be supplied to interior 101 of the machine.

Reference numerals 106, 107 by way of example denote possible devices for regulating the supply of air, e.g. control valves, via which the supply of air from air supply system 104 to interior 101 of the machine can be regulated. For example, said possible control valves can regulate the air exiting from air outlet openings of air supply system 104.

Device 100 can also include an air supply system 111 for supplying air to bottom region 115 of interior 101, which is likewise illustrated by way of example as a ring line.

Reference numerals 108, 109 designate air supply openings of air supply system 111, by way of which, for example, specific components in interior 101 can be ventilated. Reference numeral 108 can designate by way of example a possible air supply opening for supply air for a turntable 113 of a direct printing machine. Reference numeral 109 can designate an air supply opening for supply air in the bottom region of interior 101 of the machine.

Reference numerals 110, 117 designate structural components which can be configured as air ducts for supplying and/or discharging air. For example, machine components 110, 117 can be at least in part configured as hollow components, e.g. as a hollow rectangular section, the inner cavity of which can serve as an air duct for supplying and/or discharging air and be in communication with an air supply system 104, 111 and/or with air discharge system 102, 103, 112.

For the sake of completeness, it is to be noted that the above-mentioned optional hoses for the selective supply and/or the selective discharge of air at or near individual components of the machine are not shown for reasons of clarity.

One sheet with FIG. 1 is appended. The reference numerals are there allocated as follows:

100 device for climate control of an interior of a machine

101 interior of a machine, e.g. interior of a direct printing machine

102 air discharge system, part of an air discharge system, air extraction duct, ring line configured for the selective extraction of contaminated air

103 air discharge system, part of an air discharge system, air extraction duct, ring line configured for the selective extraction of high-temperature air

104 air supply system, ring line for supplying air to the interior of the machine

105 air discharge system, central discharge, e.g. extraction tube, in the ceiling region of the interior of the machine

106 air supply opening, or control valve for regulating the supply air of an air supply opening

107 air supply opening, or control valve for regulating the supply air of an air supply opening

108 air supply opening (e.g., air supply opening for supply air to the turntable)

109 air supply opening (e.g., air supply opening for supply air in the bottom region of the interior of the machine)

110 structural component of the machine, e.g. hollow rectangular section, the cavity of which can be used as an air duct for supply air and/or exit air

111 air supply system, ring line for supplying air to the interior of the machine (e.g., to the bottom region of the interior)

112 air discharge system for discharging air from the interior of the machine

113 component of the machine, e.g. turntable in the interior of the machine

114 machine, e.g. direct printing machine

115 bottom region of the interior of the machine

116 ceiling region of the interior of the machine

117 structural component of the machine, e.g. hollow rectangular section, the cavity of which can be used as an air duct for supply air and/or exit air It is to be understood that the above description is intended to be illustrative, and not restrictive. Many other embodiments will be apparent upon reading and understanding the above description. Although embodiments of the present disclosure have been described with reference to specific example embodiments, it will be recognized that the invention is not limited to the embodiments described, but can be practiced with modification and alteration within the spirit and scope of the appended claims. Accordingly, the specification and drawings are to be regarded in an illustrative sense rather than a restrictive sense. The scope of the invention should, therefore, be determined with reference to the appended claims, along with the full scope of equivalents to which such claims are entitled.

What is claimed is:

1. A device for climate control of an interior of a machine in a food and beverage industry, the device comprising:

an air discharge system for discharging air from the interior of the machine, the air discharge system comprising:

a first air extraction duct configured for first selective extraction of contaminated air; and a second air extraction duct configured for second selective extraction of high-temperature air, wherein the first air extraction duct and the second air extraction duct of the air discharge system are configured at least in part as ring lines in a ceiling region of the interior of the machine; and an air supply system for supplying air to the interior of the machine, wherein the supplied air comprises at least one of fresh air or purified extracted air.

2. The device of claim 1, wherein the machine is a direct printing machine, the contaminated air is print mist, and the high-temperature air is air heated by light sources for at least one of hardening or curing of inks.

3. The device of claim 1, wherein the device is configured to create a first pressure within the machine that is greater than a second pressure exterior to the machine.

4. The device of claim 1, further comprising at least one of:

an air purification unit for purifying air extracted through the air discharge system; or an air cooling unit for cooling air to be supplied to the interior of the machine.

5. The device of claim 4, wherein the air purification unit comprises an activated carbon filter.

6. The device of claim 1, wherein one or more structural machine components of the machine are configured as air ducts for at least one of the supplying of the air to the interior of the machine or the discharging of the air from the interior of the machine.

7. The device of claim 1, wherein the air supply system comprises a ring manifold for the supplying of the air in the ceiling region of the interior of the machine or on a ceiling in an outer region of the machine.

8. The device of claim 1, wherein the air discharge system comprises a central discharge in the ceiling region of the interior of the machine for extraction of air from the interior of the machine.

9. The device of claim 1, wherein the air supply system comprises a plurality of air supply openings for selective supply of air to the interior of the machine.

10. The device of claim 9, wherein a majority of the plurality of air supply openings are arranged in a bottom region of the interior of the machine.

11. The device of claim 9, wherein one or more of the plurality of air supply openings comprise a control valve for regulating the supplying of the air to the interior of the machine.

12. The device of claim 1, wherein the device comprises a plurality of air outlet openings that permit air to escape from the interior of the machine to a space surrounding the machine.

13. A method for climate control of an interior of a machine in a food and beverage industry, the method comprising:

discharging air from the interior of the machine via a first air extraction duct and a second air extraction duct, wherein contaminated air is selectively extracted via the first air extraction duct, wherein high-temperature air is selectively extracted at via the second air extraction duct, and wherein the first air extraction duct and the second air extraction duct of an air discharge system are configured at least in part as ring lines in a ceiling region of the interior of the machine; and supplying air to the interior of the machine, wherein the supplied air comprises at least one of fresh air or purified extracted air.

14. The method of claim 13, wherein the first air extraction duct selectively extracts the contaminated air at components of the machine, and wherein the high-temperature air is selectively extracted at the components of the machine via the second air extraction duct.

15. The method of claim 13, wherein the machine is a direct printing machine, the contaminated air is print mist, and the high-temperature air is air heated by light sources for at least one of hardening or curing of inks.

16. The method of claim 13, wherein the discharged air is at least one of purified, temperature-controlled, dried, or humidified before at least a portion of the air discharged from the interior of the machine is again returned to the interior of the machine.

17. The method of claim 13, wherein the supplying of the air to the interior of the machine creates a first pressure in the interior of the machine that is greater than a second pressure external to the machine, wherein air from the interior of the machine is purged via air outlet openings of the machine to a space surrounding said machine.

18. A direct printing machine for use in a food and beverage industry for printing onto containers, the direct printing machine comprising:

a device for climate control, the device comprising:

an air discharge system for discharging air from an interior of the direct printing machine, the air discharge system comprising:

a first air extraction duct configured for first selective extraction of contaminated air; and a second air extraction duct configured for second selective extraction of high-temperature air, wherein the first air extraction duct and the second air extraction duct of the air discharge system are configured at least in part as ring lines in a ceiling region of the interior of the direct printing machine; and an air supply system for supplying air to the interior of the direct printing machine, wherein the supplied air comprises at least one of fresh air or purified extracted air.

* * * * *